United States Patent [19]

Loggins et al.

[11] Patent Number: 4,620,346

[45] Date of Patent: Nov. 4, 1986

[54] DEVICE TO AID IN THE REMOVAL OF RESIDUAL TEXTILE MATERIAL FROM A CORE ELEMENT

[75] Inventors: Jack Loggins; Walt Chester; Leon Walker, all of Dahlonega, Ga.

[73] Assignee: Burlington Industries, Inc., Greensboro, N.C.

[21] Appl. No.: 626,120

[22] Filed: Jun. 29, 1984

[51] Int. Cl.[4] ..... B65H 73/00

[52] U.S. Cl. ..... 28/295

[58] Field of Search ..... 28/295; 74/817

[56] References Cited

U.S. PATENT DOCUMENTS

| | | | |
|---|---|---|---|
| 489,398 | 1/1893 | Towne | 74/817 UX |
| 1,109,949 | 9/1914 | Walsh . | |
| 2,303,048 | 11/1942 | Hudson . | |
| 2,613,425 | 10/1952 | Whitaker . | |
| 3,092,889 | 6/1963 | Hayes, Sr. . | |
| 3,108,354 | 10/1963 | Hayes, Sr. . | |
| 3,137,913 | 6/1964 | Hayes, Sr. . | |
| 3,928,899 | 12/1975 | Maiworm . | |
| 4,050,355 | 9/1977 | Niskanen | 74/817 X |
| 4,078,282 | 3/1978 | van Daalen . | |

FOREIGN PATENT DOCUMENTS

| | | | |
|---|---|---|---|
| 0158490 | 1/1983 | German Democratic Rep. | 74/817 |

*Primary Examiner*—Robert R. Mackey

*Attorney, Agent, or Firm*—Cushman, Darby & Cushman

[57] ABSTRACT

A device to aid in the removal of residual textile material from a core element includes a platform to support plural core elements thereon and an indexing system to sequentially index the core elements into a cutting position. The indexing system includes an index plate fixed concentrically with respect to the platform and defines plural radially spaced-apart notches each corresponding to a respective core yarn cutting position. A pivotal base plate carries a pivotal pawl member. Camming of the base plate responsively causes the base plate to pivot in one direction thereby causing the pawl member to be disengaged from one notch and advanced to the next sequential notch. Upon pivotal movement of the base plate in a direction opposite to the one direction, advancement of the indexing plate and thus advancement of the core elements supported upon the platform occurs.

14 Claims, 12 Drawing Figures

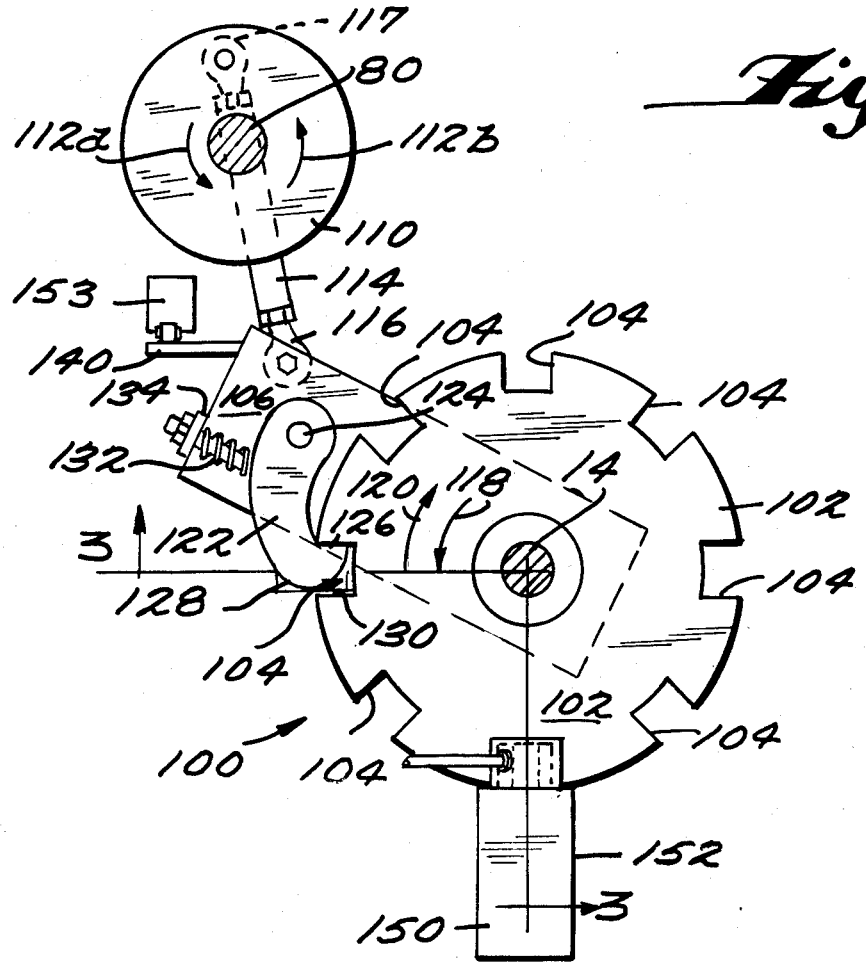
Fig. 2.
Fig. 3.
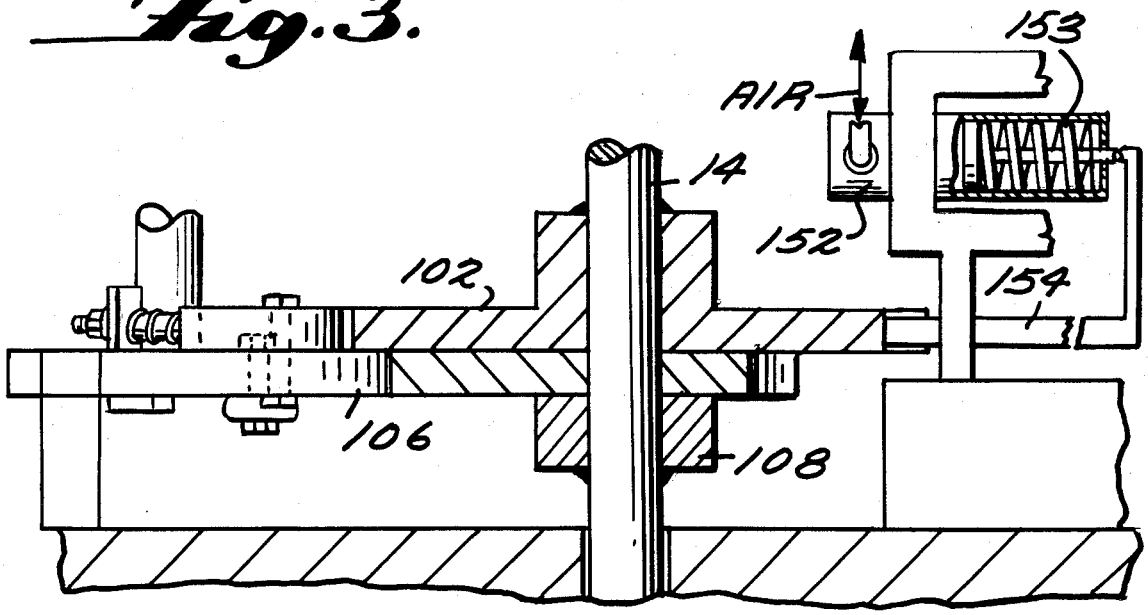

DEVICE TO AID IN THE REMOVAL OF RESIDUAL TEXTILE MATERIAL FROM A CORE ELEMENT

FIELD OF THE INVENTION

The present invention generally relates to devices which are utilized to strip residual textile material, such as yarn, thread or the like from a core element around which the textile material is wound. More particularly, the present invention relates to a device and control system for insuring semi-automatic operation of the removal of the residual textile material.

BACKGROUND OF THE PRESENT INVENTION

In many textile processes, it is typically necessary for a quantity of textile material such as yarn, thread, or the like (hereinafter collectively referred to as "yarn") to be processed automatically on bobbins or pin trucks. Many times, the yarn supply will not be completely exhausted thereby leaving a quantity of yarn as residue on the core element. Thus, there has been a need for devices which remove such residual yarn from the core element so that the residual yarn can be recycled and reprocessed so as to prevent waste.

Devices which broadly accomplish this function are generally known in this art as evidenced by U.S. Pat. Nos. 4,078,282 to van Daalen; 3,928,899 to Maiworm; 3,137,913 to Hayes, Sr.; 3,108,354 to Hayes, Sr.; 3,092,889 to Hayes, Sr.; 2,613,425 to Whitaker; 2,303,048 to Hudson; and 1,109,949 to Walsh.

Maiworm '899 cuts yarn residue from bobbins by means of a bearing which receives the cones of the bobbins and guides them to a movable cutter carriage carrying vertical and horizontal knives.

Vandaalen '282, for example, describes an apparatus for removing yarn residue from a core element or bobbin which comprises a cutting element supported by a movable support, together with a sensing device in the form of an elongated "finger" which slides longitudinally over the surface of the bobbin to detect and control the angle of a cutting edge. The surface of the sensing device follows the irregularities of the bobbin, thereby responsively causing the end of the arm and knife to rise. Thus, as the sensor follows the contours of the bobbin, it lifts the yarn residue such that it may be cut without damage to the bobbin itself.

Hayes, Sr. '913 describes a bobbin stripper having a feed chute loading to an indexed bobbin carrier. A guide or saddle move along the bobbin together with a cutter so as to prevent the cutter from contacting and damaging the bobbin.

Hayes, Sr. '354 describes a bobbin stripper wherein a rotatably mounted table supports plural bobbin carriers which are adapted to receive bobbins from a feed chute and to advance the bobbins past a cutting or stripping station where the yarn is severed from the bobbins. An ejection device automatically ejects the stripped bobbins from the bobbin carrier subsequent to the cutting operation.

Hayes, Sr. '889 describes a bobbin stripping system wherein bobbins having residual yarn therein are gravitatingly fed to a table rotatable about a horizontal axis. The bobbins are individually and sequentially accepted by the table, advanced through a cutting station whereby the residual yarn is stripped from the bobbin and, thereafter gravitatingly discharged to a discharge chute.

Walsh '949 describes the broad concept of a step-by-step turret arrangement to position a series of bobbins such that a knife may be used to remove the residue yarn. In particular, the knife cuts through the yarn on one bobbin while a brush simultaneously strips the cut yarn from a preceding bobbin. Each bobbin must be carefully pre-positioned such that a knife slot is brought into absolutely correct position for the succeeding cutting operation.

Hudson '048 utilizes gravity to feed bobbins to a conveyer which includes plural saddles spaced therealong to accept the bobbins. The conveyor thus linearly transports the bobbins past a cutting element and, upon the bobbins reaching the end of the conveyor travel, gravitatingly fall from the saddle.

Whitaker '425 discloses relative axial movement between the bobbin and a rotary knife which reciprocates in synchronism with a rotating magazine to force the bobbin in the stripping and unloading position into a hollow member such as a conduit. The Whitaker apparatus therefore requires a complex arrangement of interdependent elements which are necessary to pre-position the bobbin, remove the stripped thread, and return the cutting apparatus to its original position.

SUMMARY OF THE PRESENT INVENTION

The present invention provides a novel approach to residual yarn stripping devices in that a novel indexing and control system is utilized so as to accurately position each bobbin into a cutting position relative to a reciprocally movable saw blade so that the operator need not come into dangerous contact with any of the cutting elements.

In accordance with the present invention, therefore, there is provided a platform which is mounted for rotational movement in a predetermined direction about a substantially vertical axis. The platform includes plural core element supports each for movably supporting a core element or bobbin thereon. The core elements are radially disposed on the platform relative to the vertical axis to thereby establish plural core element positions. A cutting element, such as, for example, a rotary saw, reciprocating knife blade or like cutting means, is mounted on an arm in alignment with one of the core element positions (hereinafter termed "the cutting position") so as to be reciprocally rectilinearly movable along a cutting path which tangentially intercepts the core element along the axial length thereof when the core element is in the cutting position so as to bring the cutting element into contact with the residual yarn on the bobbin.

The indexing system of the present invention is operatively coupled to the platform. The indexing system includes an indexing plate fixed to a vertical shaft so as to be concurrently pivotal with the platform having plural notches formed at radial locations on the external periphery thereof. Each of the notches corresponds to a respective one of the core element positions. A base plate is pivotally connected to the indexing plate so as to be independently pivotally movable relative thereto about the vertical axis. A pawl member is pivotally connected to the base plate and includes an engaging surface defined at the end thereof opposite to the pivotally connected end so as to be engageable with one of the notches corresponding to the cutting position.

To advance the bobbins and thus sequentially index the bobbins into the cutting position, a driven cam is connected operatively to the base plate so as to move the base plate in a first direction to responsively disengage the pawl with one notch and to advance the pawl into engagement with a successive one of the notches so as to grasp the base plate therewith. The cam thereafter moves the pawl in a direction opposite to the first direction so that the index plate, and thus the platform, rotate about the vertical axis to index the next successive core element into the cutting position. In such a manner, the device of the present invention accurately positions each bobbin into the cutting position in a successive manner.

The control system of the present invention provides circuitry which prevents operation of the indexing system while the cutting element is enroute between a beginning position and an ending position (e.g. during that time period when the cutting element is performing its yarn cutting functions). Thus, all that is required of an operator prior to beginning operation of the device is to adjust each of the core element supports so that the lowermost portion of the cutting element is aligned substantially tangential with the outer surface of the bobbins. Thereafter, upon actuation of the device by means of the control circuitry, the operator need only remove the substantially clean bobbin (the residual yarn having fallen due to gravity into a collection site) and replace the clean bobbin manually with a fresh bobbin having residual yarn to be cut and stripped. The device of the present invention therefore operates in a semi-automatic manner in that the operator is required to manually load and unload the clean and stripped bobbins and replace them with fresh bobbins having residual yarn thereon. Thereafter however, the control and indexing systems of the present invention provide accurate positioning and cutting of the residual yarn therefrom.

Thus, the present invention provides the means by which an operator can be protected from the cutting element thereby promoting a higher degree of safety than has been the practice with completely manual systems. Furthermore, the system of the present invention is greatly simplified in design thereby promoting ease of operation and maintenance.

These as well as other advantages and objects of the present invention will become more clear to the reader after careful consideration is given to the detailed description of the preferred exemplary embodiment which follows.

BRIEF DESCRIPTION OF THE ACCOMPANYING DRAWINGS

Reference will be hereinafter made to the accompanying drawings wherein like reference numerals throughout the various figures denote like structural elements and wherein:

FIG. 2 is a top plan view of the indexing system of the present invention;

FIG. 3 is a cross-sectional elevational view taken along the line 3—3 in FIG. 2;

Figure 5A:
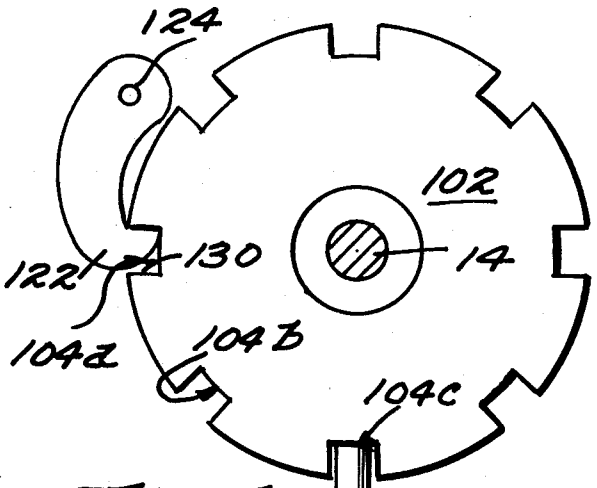
Figure 5B:
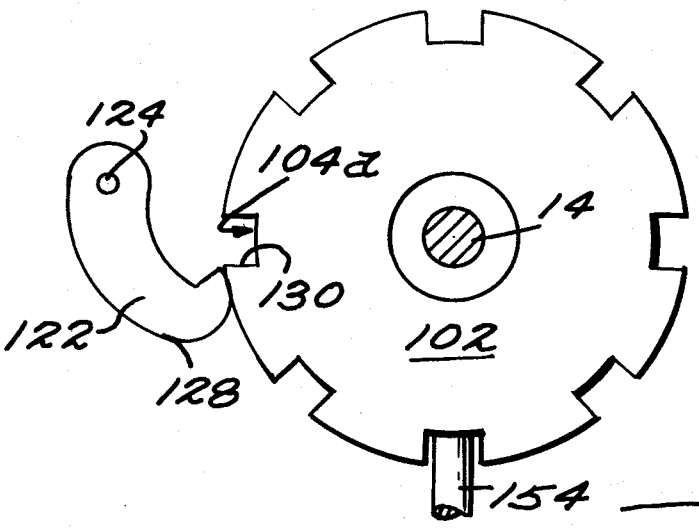
Figure 5C:
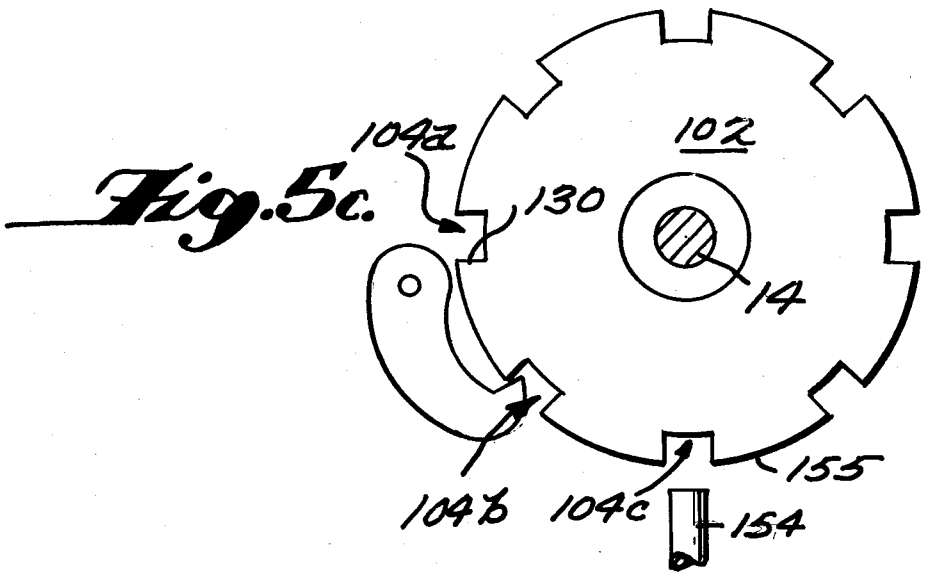
Figure 5D:
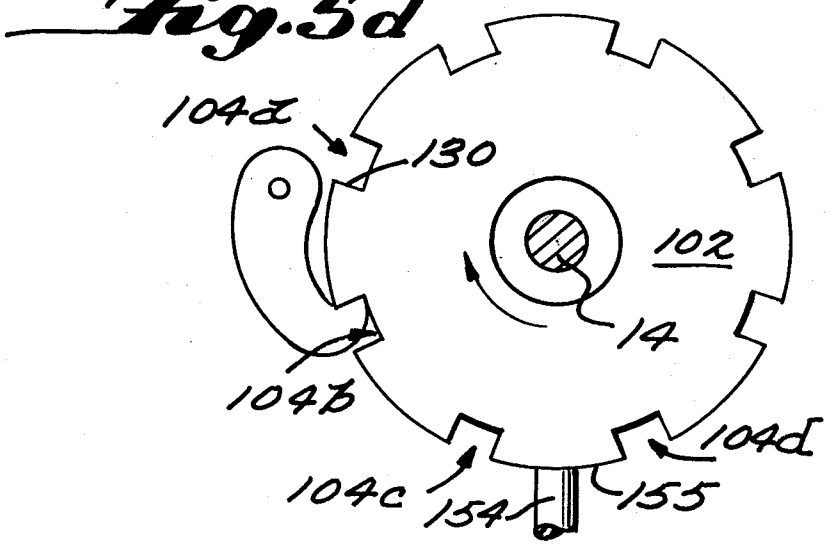
Figure 6:
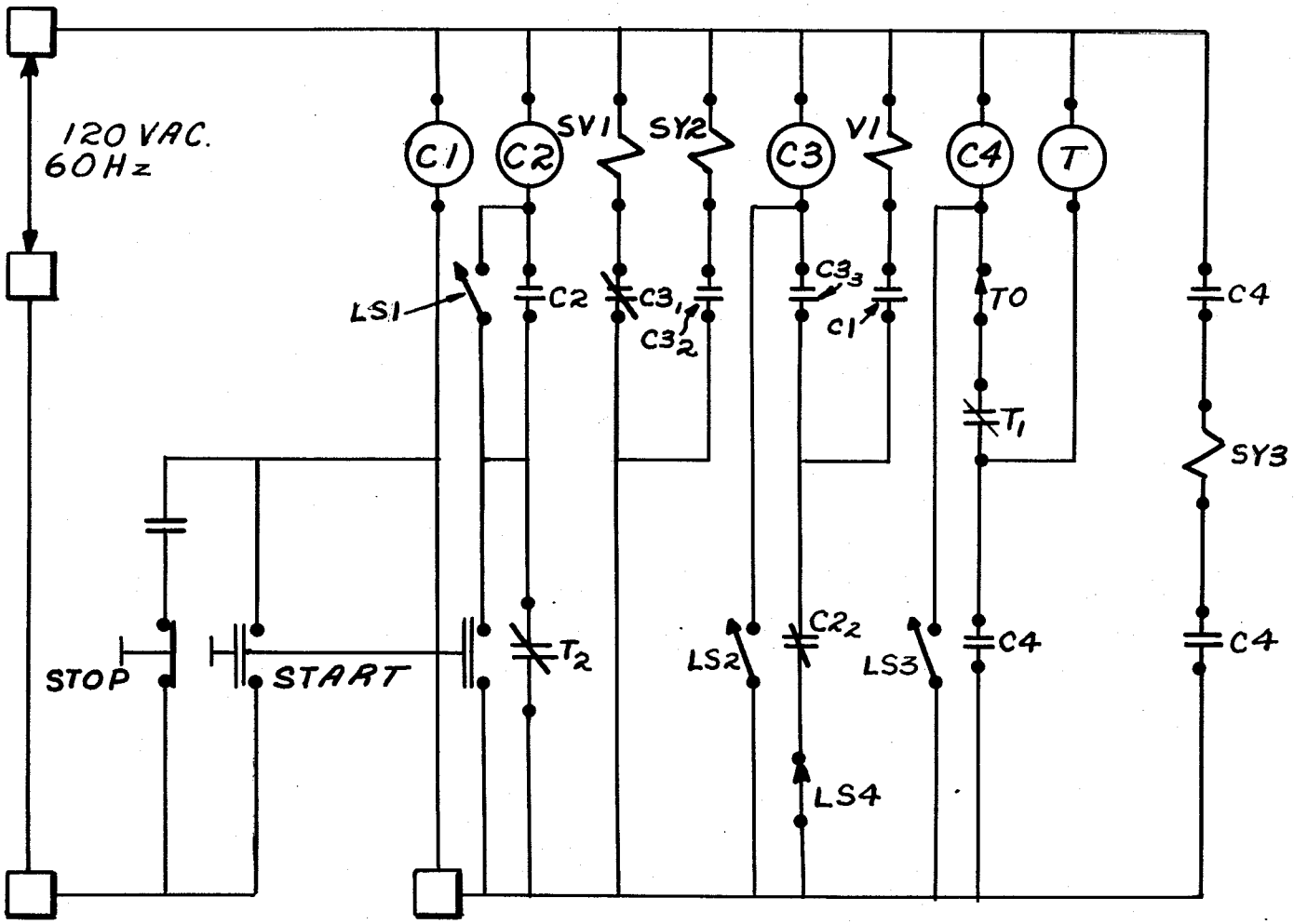

FIGS. 4A–4D schematically show the sequential operation of the cutting element relative to the platform of the present invention;

FIGS. 5A–5D schematically depict the sequence of operations for the indexing system of the present invention; and FIG. 6 is a wiring diagram of the control system of the present invention.

DETAILED DESCRIPTION OF THE PREFERRED EXEMPLARY EMBODIMENTS

Figure 1:
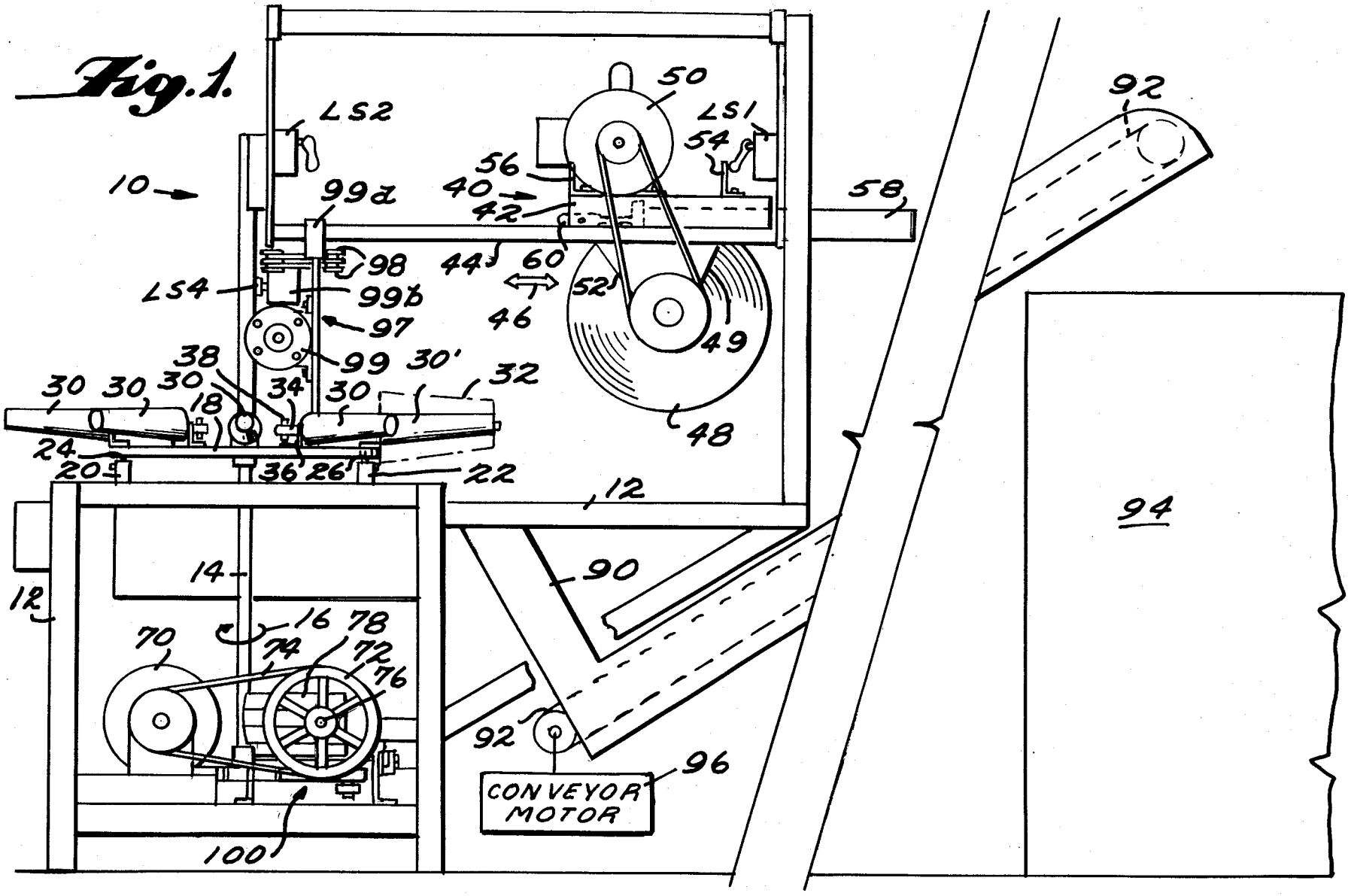
FIG. 1 is a side elevational view of the device of the present invention.

Referring to FIG. 1, it can be seen that the device 10 of the present invention generally includes a frame structure 12 for supporting the various components thereof as will be described in greater detail below. A shaft 14 is mounted to the frame 12 so as to be rotatable in the direction indicated by arrow 16 in FIG. 1 thereby defining a substantially vertical rotational axis. A substantially planar platform 18 is fixed above housing frame 12 to the shaft 14 so as to be rotatable therewith in the same direction (e.g. in the direction of arrow 16). Mounted to the upper portion of housing frame 12 are roller supports 20, 22 which aid in supporting platform 18 above frame 12 and moreover aid in its rotation due to bearing elements 24, 26 mounted therein.

Plural bobbin supports 30 are mounted to the upper surface of platform 18 at radially spaced apart, substantially equal locations thereon so as to define substantially equal indexing angles between adjacent cones thereof. Each bobbin support 30 is adapted for removably supporting a bobbin (noted by phantom line 32 in FIG. 1). Preferably, the bobbin supports 30 are pivotally mounted to the platform by means of a shaft element 34 which extends through a yoke member 36, the latter being fixed to platform 18. Shaft 34 includes a threaded set screw 38 such that upon relative turning movement being applied to set screw 38, the angular orientation of the central axis of each bobbin support 30 will be adjusted relative to the plane defined by platform 18. The adjustment capabilities and functions of bobbin supports 30 are important when consideration is given to the fact that many times the bobbin is conical in shape rather than cylindrical and thus angular inclination of the bobbin is required to present a tangent line to the cutting element. While conical-shaped bobbin supports 30 are depicted in FIG. 1, it should be understood that cylindrical or other bobbin configurations are also well within the contemplation of the present invention.

The cutting element 40 includes a support assembly 42 mounted to horizontal arm 44 so as to permit reciprocal rectilinear movement thereof (arrow 46). A rotatable saw blade 48 is dependently supported from assembly 42 by means of support plate 49. A motor 50 is operatively coupled to saw blade 48 by belt 52 so as to provide driven power to blade 48.

Position sensors in the form of limit switches LS1 and LS2 are positioned at each end of the assembly 40 to limit travel so as to define a beginning position and an ending position, respectively, for the saw blade 48. Angle members 54, 56 are fixed to assembly 42 so as to be in contact with limit switches LS1 and LS2, respectively, so as to operate the switches LS1 and LS2 when the saw is moved between the beginning and ending positions established thereby. To move cutting assembly 40 between the beginning and ending positions, there is preferably provided a double-acting air cylinder 58 which includes an actuator 60 fixed to assembly 42. Upon application of air by means not shown to cylinder 58, actuator 60 will advance and thereby advance saw blade 48. Upon reversal of the air supply to the cylinder 58, actuator 60 will retract into the cylinder 58 thereby reversing the direction of travel of the saw blade 48.

Substantially all of the yarn cut from the bobbin in the cutting position will fall by gravity into chute 90 which leads to conveyor 92. Conveyor 92 thus transports the cut yarn to a collection bin 94 so that the yarn can then be transferred to recycling and reprocessing stations.

To provide driven power to the platform 18, there is provided a motor 70 operatively coupled to a fly wheel 72 by means of belt 74. The shaft 76 of fly wheel 72 is operatively connected to gear box 78 which includes a conventional gear train which changes the horizontal rotary motion of shaft 76 into vertical rotary motion of its output shaft 80 (see FIG. 2). Output shaft 80 is operatively connected to the indexing system 100.

Saw blade 48 is preferably of the type having a non-serrated yet sharp edge. According to the present invention, therefore, there is provided a sharpening system 97 which includes a pair of sharpening belts 98 defining a nip area into which the edge of saw blade 48 can be accepted. Sharpening belts 98 are preferably conventional sand paper or other abrasive medium so as to sharpen the edge of blade 48. A sharpening motor 99 is operatively connected to belt pair 98 and are mounted for reciprocal movement to arm 44 by means of a mounting bracket 99*a*. Thus, sharpening belts 98 can be advanced towards blade 48 when desired due to the reciprocal movement provided by mounting bracket 99*a*. Limit switch LS4 is positioned with respect to the body 99*b* of sharpening belts 99*a* so that when the sharpening system 97 is advanced towards saw blade 48, air supply to cylinder 58 will be terminated thereby stopping the movement of cutting assembly 40 along arm 44. When sharpening is completed and the sharpening system 97 has been returned so that body 99*b* is once again in contact with limit switch LS4, air supply is once again resumed to cylinder 58 so that continued movement of cutting assembly 40 along arm 44 is once again permitted.

Referring now specifically to FIG. 2, there will now be described the indexing system 100 of the present invention. The indexing system 100 includes an indexing wheel 102 which includes plural notches 104 defined in the external periphery thereof. Each notch 104 is substantially equally radially spaced from adjacent notches 104 thereof and moreover coincide with each bobbin support element 30 so that a respective bobbin position is defined. A plate 106 is mounted to shaft 14 so as to be independently pivotally movable thereabout relative to indexing wheel 102. Such independent relative pivotal movement of plate 106 is established by rigidly fixing index plate 102 to shaft 14 and sandwiching plate 106 between the bottom surface of index wheel 102 by means of a rigidly fixed collar 108 (see FIG. 3).

Cam wheel 110 is fixed to output shaft 80 of gear box 78 so as to be rotatable about shaft 80 in a direction indicated by arrow 112*a* and 112*b* in FIG. 2. Rocker arm 114 is pivotally connected at one end 116 to plate 106 and at the other end 117 to cam wheel 110. One end 117 therefor rotates in a satellite motion about shaft 80 in response to rotational movement of cam wheel 110. During one half of the satellite motion of end 117, plate 106 is responsively forced to pivotally move in a direction about shaft 14 as noted by arrow 118 and during the other half of the satellite motion of end 117, plate 106 is pivotally moved in the direction of arrow 120 and is thus returned to the position shown in FIG. 2.

A pawl member 122 is pivotally attached by means of pivot pin 124 to plate 106 at one end thereof. The other end of pawl member 112 defines an engaging surface 126 to engage a portion of each notch 104 in sequence as will be described in greater detail below. The exterior surface of pawl 122 preferably defines a camming surface 128 which bears against notch surface 130 so as to cam and thus responsively outwardly displace pawl 122 during rotational movement of plate 106 in the direction of arrow 118. A compression spring 132 is fixed between a support member 134 and pawl member 122 so as to urge engaging surface 128 and pawl member 122 into engagement with notches 104. Limit member 140 fixed to plate 106 actuates a position limit switch LS3 so as to establish the condition when the indexing system is in its beginning position.

In order to positively lock and thus index each bobbin support element 30, there is provided a locking mechanism 150 which includes an air cylinder 152 operatively coupled to a reciprocally movable plunger element 154 (see FIG. 3). Air cylinder 152 is of the conventional single actuating type in that it includes a spring biased return by means of spring 153 to a beginning position as shown in FIG. 3 and upon application of pressurized air or fluid thereto, moves plunger 154 out of engagement with a respective notch 104 in registry therewith. Thus, plunger 154 reciprocally moves between a locked position with a registered notch 104 (as shown in FIG. 3) and an unlatched position whereby rotational movement of index plate 102 and thus support platform 18 are permitted.

The operation of the indexing system of the present invention can be more clearly seen from drawing FIGS. 5A–5D. As shown in FIG. 5A, pawl 122 is engaged with notch 104A which establishes the cutting position of one of the bobbin support elements 30 (e.g. support element 30′ in FIG. 1). Upon actuation of the motor 70, output shaft 80 is caused to rotate in the direction of arrow 112 thereby pivotally moving plate 106. This causes the cam surface 128 of pawl member 122 to bear against surface 130 of notch 104A and against the biased force of spring 132 (not shown in FIGS. 5A–5D) which responsively moves pawl 122 pivotally about pivot pin 124 thereby disengaging latch surface 126 with notch 104A. The disengaged condition is shown in FIG. 5B. During the disengagement of pawl member 122, plunger 154 remains in its engaged position with respect to notch 104C.

When limit switch LS3 senses that plate 106 has pivotally moved due to the disengagement of plate 140 therewith, the control system (as will be described in greater detail below) causes air to energize air cylinder 152 thereby withdrawing piston or plunger 154 from engagement with notch 104C. Meanwhile, plate 106 continues to pivot in the direction of arrow 118 and, upon surface 126 of pawl member 122 coming into registry with the next successive notch 104B, the biased force provided by spring 132 urges pawl member 122 into engagement with notch 104B. At this time, end 117 of cam wheel 110 has reached the end of its first half of satellite movement (noted by arrow 112A) so that direction reversal (arrow 120) of plate 106 is effected. Thus, as plate 106 pivots in the direction of arrow 120, index wheel 102 is also caused to pivot in the direction of arrow 120 thereby advancing notch 104B into the position previously occupied by notch 104A thereby indexing notch 104B into the cutting position.

Substantially midway through the travel of notch 104B into the cutting position, the control system terminates the air supply to cylinder 152 thereby causing its internal biasing spring 153 to force plunger 154 against the peripheral surface 155 of index wheel 102. Thus, upon the next successive notch 104D in the direction of rotation of index wheel 102 coming into registry with plunger 154, the internal spring 153 forces plunger 154 into latching engagement therewith thereby accurately positioning the next successive bobbin support relative to the cutting path of the cutting element. Substantially at the same time, the driven power to cam wheel 110 is terminated thus stopping the rotation of platform 18.

Figure 4A:
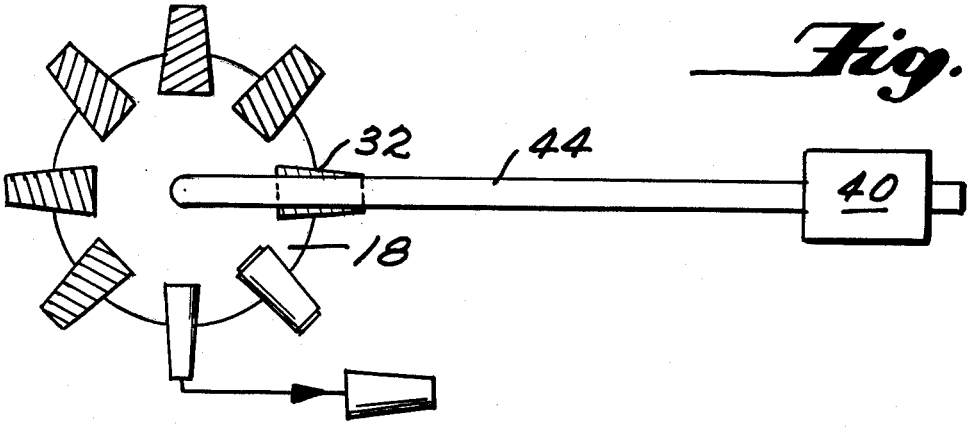
Figure 4B:
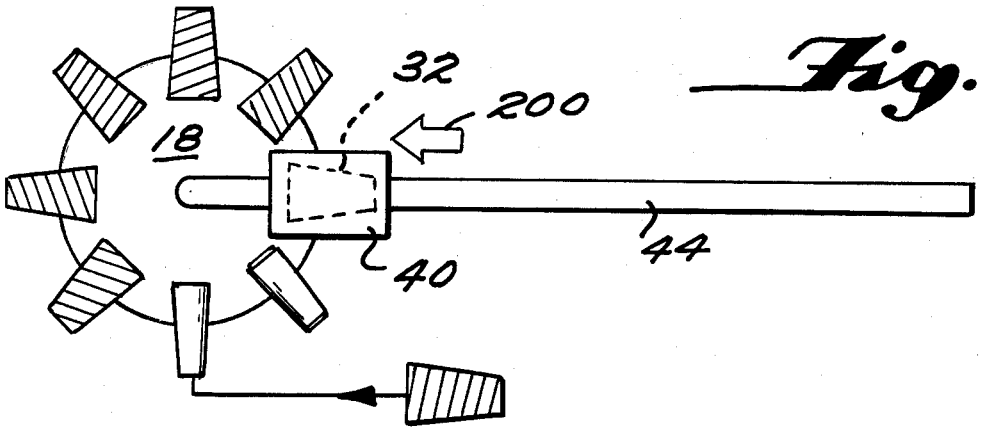
Figure 4C:
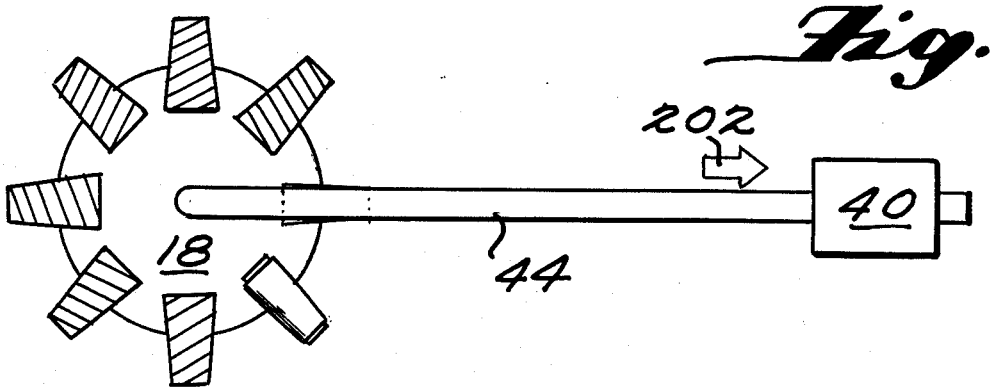
Figure 4D:
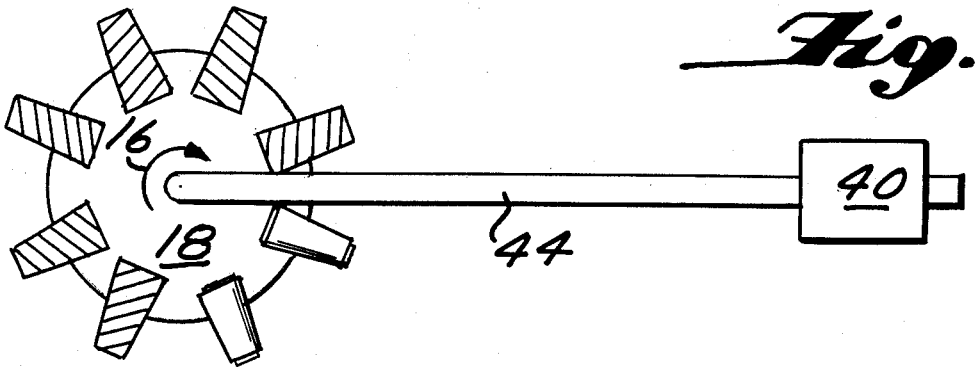

The overall operation of the cutting element 40 relative to the bobbins supported on each bobbin support is schematically shown in FIGS. 4A–4D. As shown in FIG. 4A, the cutting element 40 advances from a beginning position in the direction of arrow 200 (see FIG. 4B) so as to cut the residual yarn from the bobbin which is in cutting position. The cutting element 40 will then retreat in the direction of arrow 202 to the beginning position as shown in FIG. 4C and the platform 18 will index the next successive bobbin into the cutting position. Substantially all of the cut yarn from the bobbin will fall due to gravity and be transported to the collection bin 94 by means of the conveyor 92 previously described. However, some yarn may remain on the bobbin (as shown in FIGS. 4B–4D) and in such a case, the operator manually removes such excess yarn and places it in a separate collection site. As shown in FIG. 4B, a fresh bobbin is then placed on the empty bobbin support element. This process of cutting, stripping and manually replacing stripped bobbins is repeated until the desired number of bobbins have been stripped.

The control system of the present invention can be more clearly seen from FIG. 6. As shown therein, upon manual operation of the start button, power is supplied through solenoid valve SV1 so as to permit air to pressurize cylinder 58 to move the cutting element in a forward direction. Upon limit switch LS2 sensing the end position of travel for the cutting element 40, LS1 closes thereby energizing relay C3 causing relay contact $C3_1$ to open and relay contact $C3_2$ to close thereby energizing solonoid valve SV2 while concurrently deenergizing solonoid valve SV1. Upon energization of solonoid valve SV2, the direction of the air cylinder 58 is reversed thereby reversing the direction of the cutting element 40. Relay C1 also energizes upon operation of the start button thereby supplying power to both the conveyor motor 96 and saw motor 50. Relay C1 latches main air supply valve V1 so that air is supplied to the various solenoid valves SV1, SV2 and SV3 of the control system.

When the cutting assembly has been disengaged from limit switch LS2, limit switch LS2 returns to its normally open condition but relay C3 remains latched into circuit by means of contact $C3_3$. When the cutting element 40 has returned to its beginning position, limit switch LS1 is moved to a closed position thereby energizing relay C2 which causes contact $C2_2$ to deenergize relay C3 thereby returning the air system of solenoid valve SV1 and SV2 to its beginning state (e.g. the state wherein SV1 will next be energized so as to move the saw blade in a forward direction). At the same time, the main air supply valve V1 is deenergized to prevent inadvertent movement of the saw blade 48 during rotation of the platform 18. Upon energization of relay C2, motor 70 is energized thereby causing the platform 18 to rotate and index the next successive bobbin support 30 as previously described. Limit switch LS3 will sense movement of plate 106 and thus will close thereby energizing relay C4 which energizes air valve SV3 to move latch bar 154 out of engagement with a respective notch 104 in registry therewith. Upon energization of timer T at the same time, the index plate will have rotated substantially through half of the angular indexing distance required for indexing the next successive bobbin support member. Elapse of a predetermined time required to move the index plate through this indexing angle will cause timer T to time out thereby opening the normally closed contact $T_1$ to deenergize relay C4 thereby deenergizing solenoid valve SV3 and causing air cylinder 152 to move latching plunger 154 into engagement with the external periphery 155 of the index plate 102.

At the same time that contact T1 opens, contact T2 will also open thereby deenergizing relay C2 thus stopping operation of platform motor 70. However, sufficient inertia is present in the indexing system to permit the pawl member 122 to move index plate 102 an additional amount sufficient to register a notch with plunger 154 whereupon rotation of plate 102 ceases due to engagement of plunger 154 therewith. At the same time, the cutting element 40 is once again permitted to begin its forward travel by virtue of the re-energization of the main air valve V1.

Limit switch LS4 (described previously) de-energizes main air supply valve V1 thereby stopping movement of cutting assembly 40 along arm 44 to permit sharpening assembly 97 to be moved into sharpening position with saw blade 48.

As can be seen from the above description, the present invention provides means by which the residual yarn on a bobbin core element can be cut and stripped from the bobbin. Thus, while the present invention has been described in what has presently conceived to be the most preferred and exemplary embodiments thereof, those in the art may appreciate that many modifications may be made hereto, which modifications shall be accorded the broadest scope of the appended claims so as to encompass all equivalent structures, devices and assemblies.

We claim:

1. A device to and in the removal of residual textile material from a core element around which the textile material is wound, said device comprising in combination:

a platform mounted for rotational movement in a predetermined direction about a substantially vertical axis and including plural core element support means each for removably supporting a core element thereon, said plural support means being radially disposed at separated locations on said platform relative to said substantially vertical axis to thereby establish plural core element positions and wherein at least one of said core element positions defines a cutting position;

indexing means operatively connected to said platform for rotating said platform in a predetermined direction about said substantially vertical axis to simultaneously move each said plural support means through an indexing angle thereby sequentially indexing said core elements into said cutting position;

cutting means for cutting said residual textile material from a core element indexed into the cutting position and including means to mount said cutting means for substantially reciprocal rectilinear movement along a cutting path between starting and ending positions, said cutting path being in alignment with said core element in said cutting position so that said cutting means cuts the residual textile material wound upon said core element as said cutting means moves along said cutting path in a direction from said starting position to said ending position, substantially all of said cut textile material thereby gravitationally falling from said core element;

move means operatively connected to said cutting means for reciprocally moving said cutting means between said starting and ending positions;

control means operatively connected to said indexing means and said moving means for synchronizing the rotation of said platform with the reciprocal movement of said cutting means so that said moving means moves said cutting means into said ending position in response to said indexing means indexing a core element into said cutting position; and sharpening means movable from an initial position to a position into engagement with said cutting means for sharpening said cutting means, said control means including means to stop reciprocal movement of said cutting means upon movement of said sharpening means from said initial position towards said engagement position with said cutting means and to resume reciprocal movement of said cutting means upon return of said sharpening means to said initial position; wherein said indexing means includes:

(a) index plate means concentrically fixed to said platform for defining a plurality of radially spaced-apart notches, each corresponding to a respective one of said core element positions;

(b) base plate means pivotally connected to said index plate means for independent pivotal movement about said axis relative to said index plate means;

(c) pawl means pivotally connected to said base plate means and operatively engageable with said notches;

(d) cam means connected to said base plate means for pivotally moving said base plate means in a first direction to responsively disengage said pawl means with one said notch and to advance said pawl means into engagement with a successive one of said notches and for moving said pawl means in response to engagement with said successive one notch in a second direction, opposite to said first direction, to cause said platform to rotate and thus index said successive core elements into said cutting position.

2. A device as in claim 1 wherein said pawl means includes biasing means to bias said pawl means into engagement with said successive notch.

3. A device as in claim 1 wherein said indexing means includes motor means for providing driven power to said cam means.

4. A device as in claim 3 wherein said cam means includes (i) disc means connected to said motor means and mounted for rotational movement about a cam axis, and (ii) rod means having a first end pivotally connected to said plate means and a second end pivotally connected to said disc means at a pivot point thereon, said pivot point moving in satellite motion about said cam axis in response to rotational movement of said disc means.

5. A device as in claim 4 wherein said indexing means includes latch means for latching said index plate means in said cutting position.

6. A device as in claim 5 wherein said latch means includes a latch bar and means to reciprocally move said latch bar between latched and unlatched positions with respect to a predetermined one of said notches.

7. A device as in claim 6 wherein said means to move said latch bar includes a solenoid valve.

8. A device as in claim 1 wherein said pawl means includes at one end means defining a cam surface, said cam surface defining means engaging a portion of a respective position notch to thereby pivot said pawl means to permit disengagement thereof.

9. A device to cut residual textile material from a core element comprising:

a platform mounted for rotational movement in a predetermined direction about a substantially vertical axis and including plural core element support means each for removably supporting a core element thereon, said plural support means being radially disposed at separated locations on said platform relative to said substantially vertical axis to thereby establish plural core element positions and wherein at least one of said core element positions defined a cutting position;

indexing means operatively connected to said platform for rotating said platform in a predetermined direction about said substantially vertical axis to simultaneously move each said plural support means through an indexing angle thereby sequentially indexing said core elements into said cutting position;

cutting means for cutting said residual textile material from a core element indexed into the cutting position and including means to mount said cutting means for substantially reciprocal rectilinear movement along a cutting path between starting and ending positions, said cutting path being in alignment with said core element in said cutting position so that said cutting means cuts the residual textile material wound upon said core element as said cutting means moves along said cutting path in a direction from said starting position to said ending positin, substantially all of said cut textile material thereby gravitationally falling from said core element;

moving element means operatively connected to said cutting means for reciprocally moving said cutting means between said starting and ending positions; and control means operatively connected to said indexing means and said moving means for synchronizing the rotation of said platform with the reciprocal movement of said cutting means so that said moving means moves said cutting means into said ending position in response to said indexing means indexing a core element into said cutting position; wherein said indexing means includes:

(a) index plate means concentrically fixed to said platform for defining a plurality of radially spaced-apart notches, each corresponding to a respective one of said core element positions;

(b) base plate means pivotally connected to said index plate means for independent pivotal movement about said axis relative to said index plate means;

(c) pawl means pivotally connected to said base plate means and operatively engageable with said notches;

(d) cam means connected to said base plate for pivotally moving said base plate in a first direction to responsively disengage said pawl means with one said and to advance said pawl means into engagement with a successive one of said notches and for moving said pawl means in response to engagement with said successive one notch in a second direction, opposite to said first direction, to cause said platform to rotate and thus index said successive core elemens into said cutting position; and (e) latch means including a latch member reciprocally movable into and out of engagement with one of said notches in registry therewith to arrest movement of said index plate means and to ensure positioning of a core element into said cutting position; wherein said control means includes:

(i) timing means operatively connected to said latch means for establishing a predetermined time interval corresponding to movement of said support means through a portion of said indexing angle, and (ii) means for sensing movement of said base plate in said first direction to responsively withdraw said latch member from engagement with a respective notch to thereby permit said pawl means to rotate said platform and to initiate said timing means, wherein (iii) said timing means, upon elapse of said predetermined time interval causes said latch member to be advanced toward said index plate means prior to registry of a next sequential notch therewith by virtue of said time interval corresponding to said indexing angle portion, whereby upon continued rotation of said support means through the remaining portion of said indexing angle, said latch member moves into engagement with said next sequential notch.

10. A device as in claim 9 wherein said latch means includes biasing means for biasing said latch member in said advancing direction to thereby cause said latch member to be biased into engagement with a respective notch when the latter is moved into registry with said latch member.

11. A device as in claim 9 further comprising sharpening means movable from an initial position to a position into engagement with said cutting means for sharpening said cutting means.

12. A device as in claim 11 wherein said sharpening means includes means to mount said sharpening means in confronting relationship to said cutting means at said ending position and to permit reciprocal movement of said sharpening means between a sharpening position wherein sharpening of said cutting means is permitted and a retracted position wherein sharpening of said cutting means is prevented.

13. A device as in claim 12 wherein said sharpening means includes stopping means operatively connected to said moving means for stopping movement of said cutting means in response to said sharpening means being advanced to said sharpening position.

14. A device to aid in the removel of residual textile material from a core element comprising in combination:

a platform mounted for rotational movement about an indexing axis and including plural support means each for supporting a respective one of a plurality of core elements and to establish respective core element positions radially of said indexing axis, at least one of said core element positions corresponding to a cutting position;

indexing means connected to said platform for rotating said platform about said indexing axis to thereby sequentially index said core elements into said cutting position;

cutting means in alignment with said cutting position and reciprocally movable between starting and ending positions relative to said cutting position for cutting residual textile material from said core element in said cutting position;

moving means operatively connected to said cutting means for reciprocally moving said cutting means between said starting and ending positions;

control means operatively connected to said indexing means and said moving means for synchronizing the rotation of said platform with the reciprocal movement of said cutting means so that said moving means moves said cutting means into said ending position in response to said indexing means indexing a core element into said cutting position; and sharpening means movable from an initial position to a position into engagement with said cutting means for sharpening said cutting means, said control means including means to stop reciprocal movement of said cutting means upon movement of said sharpening means from said initial position towards said engagement position with said cutting means and to resume reciprocal movement of said cutting means upon return of said sharpening means to said initial position.

* * * * *